US007434682B2

(12) United States Patent
Valenzano et al.

(10) Patent No.: US 7,434,682 B2
(45) Date of Patent: Oct. 14, 2008

(54) U-SHAPED PACKAGING STRUCTURE WITH ONE HINGED LEG FOR MOVEMENT BETWEEN 90° AND 180° POSITIONS, AND A PACKAGING ASSEMBLY, THEREOF

(75) Inventors: Frank Valenzano, West Monroe, LA (US); Richard G. Faircloth, West Monroe, LA (US); Billy Sykes, West Monroe, LA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/898,957

(22) Filed: Jul. 27, 2004

(65) Prior Publication Data

US 2006/0021895 A1 Feb. 2, 2006

(51) Int. Cl.
*B65D 85/00* (2006.01)
*B65D 5/00* (2006.01)

(52) U.S. Cl. ..... 206/215; 206/555; 229/122

(58) Field of Classification Search ..... 206/215, 206/449, 555; 229/122, 125.22, 125.32, 229/125.19

See application file for complete search history.

(56) References Cited

U.S. PATENT DOCUMENTS 2,540,480 A * 2/1951 Gibson ..... 206/215
3,015,430 A * 1/1962 Bauer ..... 229/122
3,543,994 A * 12/1970 Clark ..... 229/125.32
4,323,187 A * 4/1982 Gillie ..... 229/125.32
4,976,374 A 12/1990 Macaluso
5,630,545 A * 5/1997 Jaglowitz ..... 229/125.19
5,947,290 A 9/1999 Loeschen
6,382,447 B1 * 5/2002 Loeschen ..... 229/125.22

* cited by examiner

*Primary Examiner*—Bryon P. Gehman
(74) *Attorney, Agent, or Firm*—Law Offices of Steven W. Weinrieb

(57) ABSTRACT

A new and improved packaging structure comprises a base member and a pair of oppositely disposed upstanding side wall portions, wherein at least one of the interior corner regions, defined at the intersection between one of the side wall portions and the base member, is scored so as to permit the side wall portion to be pivotally moved between a first position perpendicular to the base member, and a second position coplanar with the base member. In this manner, articles can be inserted in a sideways direction into the packaging structure. In addition, the articles will be properly aligned and spaced from the side wall portion when the side wall portion is returned to its perpendicular position so as to accommodate a dependent side wall portion of a second packaging structure so as to form a composite packaging assembly.

13 Claims, 5 Drawing Sheets

U-SHAPED PACKAGING STRUCTURE WITH ONE HINGED LEG FOR MOVEMENT BETWEEN 90° AND 180° POSITIONS, AND A PACKAGING ASSEMBLY, THEREOF

FIELD OF THE INVENTION

The present invention relates generally to a packaging structure, and more particularly to a new and improved packaging structure, apparatus for making the same, and a packaging assembly comprising a pair of mating packaging structures, wherein each packaging structure is fabricated from laminated paperboard, has a substantially U-shaped cross-sectional configuration, and is uniquely structured in that at least one of the oppositely disposed upstanding side wall portions or leg members of the packaging structure is movable between a 90° upstanding position, and a 180° coplanar position, with respect to the base member of the packaging structure, as a result of the scoring of the interior corner joint region defined between the side wall portion or leg member and the base member, so as to facilitate the insertion or disposition of substantially flat or planar articles into and within the packaging structure in a desirably aligned manner when the side wall portion or leg member is moved from its 90° upstanding position, to the 180° coplanar position, and back to its 90° upstanding position. A pair of the packaging structures form a packaging assembly fully enveloping the articles therewithin.

BACKGROUND OF THE INVENTION

Substantially flat or planar articles, having substantial thickness and length dimensions, such as, for example, plate glass members, garage doors, and the like, need to be protected during, for example, transportation and shipping thereof from their manufacturing facilities to their storage and/or point of sale locations so as to prevent damage from occurring to such articles prior to the purchase of the same by consumers. It is conventional practice to utilize substantially rigid, laminated U-shaped channel structures so as to effectively define composite packaging containers, which encase the articles therewithin, whereby the channel structures can subsequently be secured together by means of, for example, suitable strapping or banding. One type of conventional packaging structure, which has been utilized for the foregoing purposes, is disclosed, for example, within U.S. Pat. No. 4,976,374 which issued to Macaluso on Dec. 11, 1990. More particularly, as disclosed within FIG. 1, which substantially corresponds to FIG. 3 of the aforenoted patent, it is seen that the composite packaging container comprises a substantially U-shaped base unit 10 and a substantially U-shaped cover unit 12. The substantially U-shaped base unit 10 is seen to comprise a base or bottom portion 10*a*, and a pair of oppositely disposed, upstanding side wall portions or leg members 10*b*, 10*c* integrally connected to the base or bottom portion 10*a*, while the substantially U-shaped cover unit 12 is seen to comprise a cover or top portion 12*a*, and a pair of oppositely disposed, dependent side wall portions or leg members 12*b*, 12*c* integrally connected to the cover or top portion 12*a*.

When the articles 18 are to be disposed within the composite packaging container, the articles 18 are initially inserted within the substantially U-shaped base unit 10 so as to be interposed between the oppositely disposed, upstanding side wall portions or leg members 10*b*, 10*c* thereof, and simultaneously supported upon the base or bottom portion 10*a* of the base unit 10, and subsequently, the substantially U-shaped cover unit 12 is disposed over the substantially U-shaped base unit 10 so as to be structurally mated therewith in order to effectively form the composite packaging container in which the articles 18 are adapted to be encased. Lastly, the base unit 10 and the cover unit 12 are secured together by means of suitable strapping or banding 16. It is noted, however, that the base units 10 and the cover units 12 comprise substantially rigid and inflexible structures, and accordingly, it can therefore be appreciated that the oppositely disposed, upstanding side wall portions or leg members 10*b*, 10*c* of the base unit 10 are separated from each other by means of, for example, a predeterminedly fixed distance defined therebetween. Therefore, it is sometimes difficult to properly insert the articles 18, having a predetermined lateral extent or width dimension which is only slightly less than the predetermined distance defined between the pair of oppositely disposed, upstanding side wall portions or leg members 10*b*, 10*c*.

In addition to the aforenoted packaging structure as disclosed within the patent to Macaluso, a somewhat differently structured packaging structure is disclosed within U.S. Pat. No. 5,947,290 which issued to Loeschen on Sep. 7, 1999. As disclosed within FIG. 1*a*, which substantially corresponds to FIG. 1 of Loeschen, it is seen that the packaging structure, generally indicated by means of the reference character 10, comprises an upper base member 14 and a pair of dependent side members 16, 16. The dependent side members 16, 16 cooperate with the upper base member 14 so as to define therewith corner junctions 18, 18, and it is seen that such corner junctions 18, 18 are externally scored as at 20, 20 such that internal living hinges are defined as at 22. Such hinge structures, however, permit the dependent side members 16, 16 to therefore be moved laterally outwardly, in opposite directions, with respect to the upper base member 14 so as to be disposed, for example, at an angle of 50°, with respect to the upper base member 14. It can therefore be seen that this packaging structure 10 would not permit articles to be inserted into the containment space of the packaging structure in a laterally sideways direction, and does not provide a rigidly upstanding side wall against which side edge portions of the articles can be abutted and aligned.

A need therefore exists in the art for a new and improved packaging structure, an apparatus for making the same, and a composite packaging assembly, wherein the packaging structure can be structured so as to still have the substantially U-shaped cross-sectional configuration within which the articles can be accommodated and contained, and yet which is also uniquely structured so as to facilitate the insertion or disposition of substantially flat or planar articles into and within the packaging structure in a desirably aligned manner, and still yet further, to effectively automatically align side edge portions of the articles to be inserted and contained within the packaging structure.

SUMMARY OF THE INVENTION

The foregoing and other objectives are achieved in accordance with the teachings and principles of the present invention through the provision of a new and improved packaging structure which comprises a substantially U-shaped structure comprising a base member and a pair of oppositely disposed upstanding side wall portions or leg members. The packaging structure is fabricated, for example, from laminated paperboard, and at least one of the interior corner regions, defined at the intersection or joint between one of the oppositely disposed upstanding side wall portions or leg members and the base member, is scored so as to permit that particular upstanding side wall portion or leg member to be pivotally movable between a first position at which the side wall portion or leg member is disposed perpendicular, or at an angle of 90°, with respect to the base member, and a second position at which the pivotally movable side wall portion or leg member is disposed in a coplanar manner, or at an angle of 180°, with respect to the base member.

In this manner, when substantially flat or planar articles are to be inserted into and disposed within the packaging structure, the pivotally movable upstanding side wall portion or leg member is able to be moved from its 90° or upright position, perpendicular to the base member, to its 180° or lowered coplanar position with respect to the base member, so as to enable the articles to be moved laterally across the upper surface of the base member until an edge portion of each article abuts the oppositely disposed upstanding side wall portion or leg member of the packaging structure. Accordingly, uniform alignment of all of the articles within the packaging structure is ensured. Subsequently, when all of the articles are disposed within the packaging structure, the pivotally movable side wall portion or leg member is then of course moved or returned from the aforenoted 180° or lowered coplanar position, back to the aforenoted 90° or upright position, with respect to the base member so as to effectively entrap the articles between the pair of oppositely disposed upstanding side wall portions or leg members.

As a result of the aforenoted alignment of the articles, the oppositely edge portions of the articles are also spaced from the side wall portion which has been returned to its upright position. In order to complete the packaging assembly, a similarly configured second packaging structure is mated with the first packaging structure so as to fully encase or envelop the articles therewithin, and suitable strapping bands are secured around the completed packaging assembly. It is noted that one of the dependent side wall portions of the second packaging structure is disposed externally of the side wall portion against which the side edge portions of the articles have been abutted, while the other dependent side wall portion of the second packaging structure is disposed within the space defined between the opposite aligned edge portions of the articles and pivotal side wall portion of the first packaging structure. The apparatus for achieving the aforenoted scoring of the interior corner joint region of the packaging structure comprises a free-wheeling rotary cutting blade mechanism which is adapted to cooperate with a free-wheeling support roller for effectively supporting the elongated laminated paperboard product being conveyed along the longitudinal extent thereof and prior to the cutting of the same into its predetermined length units for its predetermined end uses.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
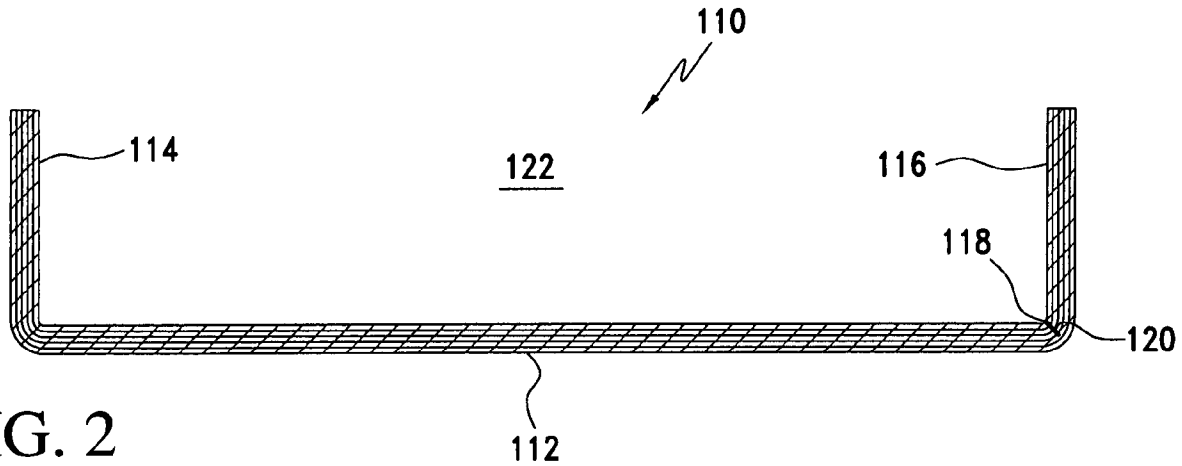
FIG. 2 is a cross-sectional view of a new and improved packaging structure, constructed in accordance with the principles and teachings of the present invention and showing the cooperative parts thereof, wherein the illustrated packaging structure has a substantially U-shaped cross-sectional configuration comprising a base member, and a pair of oppositely disposed upstanding side wall portions or leg members, with both side wall portions or leg members disposed at 90° with respect to the base member so as to define the position at which the packaging structure can retain the substantially flat or planar articles therein.

Referring now to the drawings, and more particularly to FIG. 2 thereof, a new and improved packaging structure, constructed in accordance with the teachings and principles and teachings of the present invention, and showing the cooperative parts thereof, is disclosed and is generally indicated by the reference character 110. The packaging structure 110 is fabricated from laminated paperboard, and is seen to have a substantially U-shaped cross-sectional configuration which comprises a base or bottom member 112, and a pair of oppositely disposed, upstanding left and right side wall portions or leg members 114, 116 integrally connected to the base or bottom member 112. Both of the oppositely disposed, upstanding left and right side wall portions or leg members 114, 116 are normally disposed substantially perpendicular to the base or bottom member 112, that is, at an angle of 90°, when, for example, the new and improved packaging structure 110 is to be utilized in connection with the containment of substantially flat or planar articles therein, however, in accordance with the unique and novel principles, teachings, and structure characteristic of the present invention packaging structure 110, a corner region 118 of the packaging structure 110, as defined between the right side upstanding wall portion or leg member 116 and the base or bottom member 112, is adapted to be scored upon the interior surface portion thereof, as disclosed at 120, so as to extend only partially through the entire thickness dimension, defined by means of the laminated structure comprising or defining the laminated paperboard from which the packaging structure 110 is manufactured, to a predetermined depth dimension.

Figure 3:
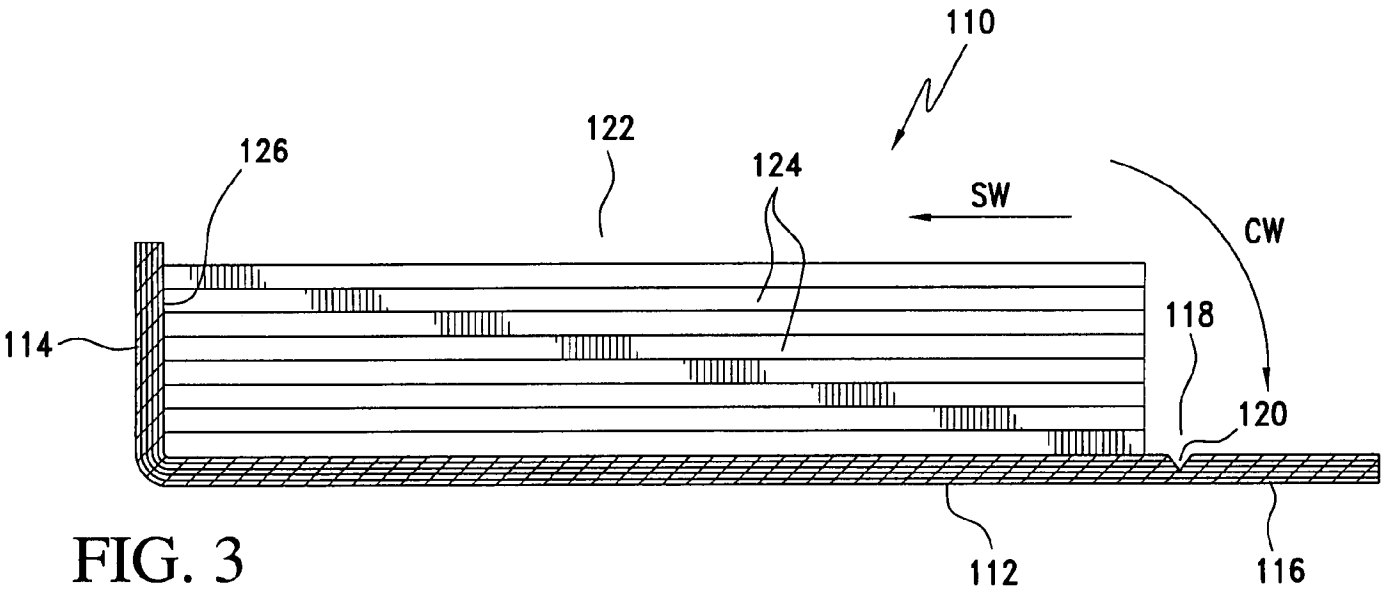
FIG. 3 is a cross-sectional view, similar to that of FIG. 2, of the new and improved packaging structure, constructed in accordance with the principles and teachings of the present invention and showing the cooperative parts thereof, wherein the illustrated packaging structure having the substantially U-shaped cross-sectional configuration comprising the base member and the pair of oppositely disposed upstanding side wall portions or leg members, wherein one of the side wall portions or leg members is disposed at 180° with respect to the base member so as to facilitate the insertion of substantially flat or planar members within the packaging structure.

In this manner, the scoring of the interior surface portion of the corner region 118 effectively provides the same with living hinge structure such that, as can be clearly appreciated from additional reference being made to FIG. 3, the normally upstanding right side wall or leg member 116 of the packaging structure 110 may be pivotally moved, for example, in the clockwise direction as indicated by means of the arrow CW, from its first disposition at which it is disposed substantially perpendicular to, or at an angle of 90°, with respect to the base or bottom member 112, to a second disposition at which it is disposed substantially coplanar, or at an angle of 180°, with respect to the base or bottom member 112. As a result of providing the normally upstanding right side wall or leg member 116 of the packaging structure 110 with the aforenoted pivotal hinge structure, the interior container region 122 of the packaging structure 110, which of course is open or accessible from the uncovered upper or top portion thereof, but more importantly, such interior container region 122 of the packaging structure 110 is now effectively opened and accessible from the side portion thereof. Accordingly, when a plurality of substantially flat or planar articles 124 are to be deposited into the interior container region 122 of the packaging structure 110, the substantially flat or planar articles 124 can be simply moved in a sideways direction, as denoted by means of the arrow SW. In this manner, the deposition of the substantially flat or planar articles 124 into the interior container region 122 of the packaging structure 110 facilitated and simplified. The reason for this may be readily appreciated, for example, as a result of additional reference being made to FIG. 4.

Figure 4:
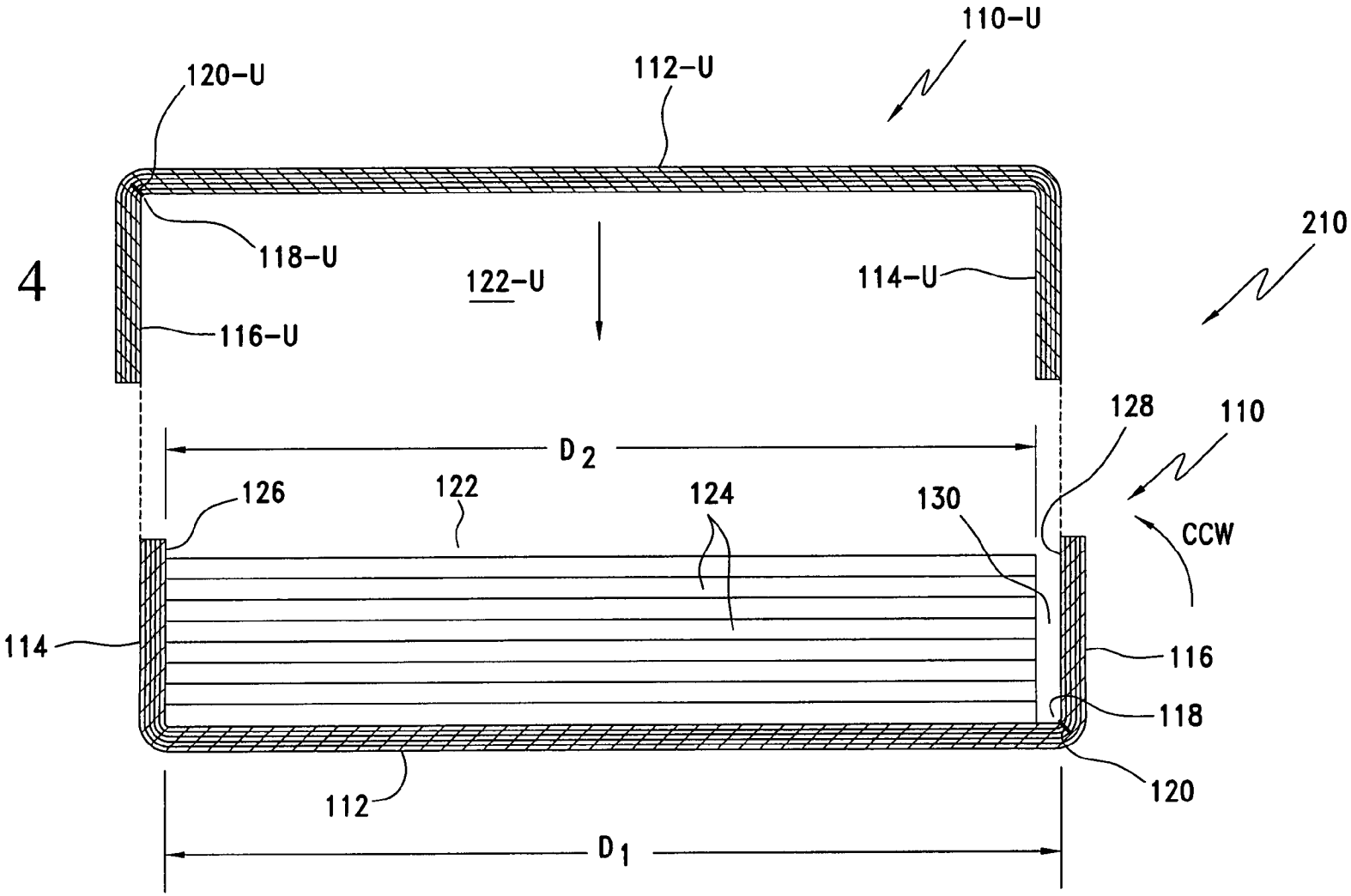
FIG. 4 is a cross-sectional view of a new and improved packaging assembly, constructed in accordance with the principles and teachings of the present invention and showing the cooperative parts thereof, wherein the illustrated packaging assembly comprises a pair of packaging structures, as illustrated within FIG. 1, wherein the pair of packaging structures are effectively mated with each other so as to contain and confine a plurality of substantially flat or planar articles therein.

More particularly, as disclosed within FIG. 4, it can be seen that the interior container region 122 of the packaging structure 110, as defined between the oppositely disposed interior wall surfaces of the oppositely disposed upstanding left and right side wall portions or leg members 114, 116, has a predetermined width dimension $D_1$, whereas the width dimension of the plurality of substantially flat or planar articles 124, to be contained and confined within the interior container region 122 of the packaging structure 110, has a predetermined value of $D_2$ which is slightly less than that of the predetermined width dimension $D_1$ of the interior container region 122 of the packaging structure 110 as defined between the oppositely disposed interior wall surfaces of the oppositely disposed upstanding left and right side wall portions or leg members 114, 116 of the packaging structure 110.

Figure 1:
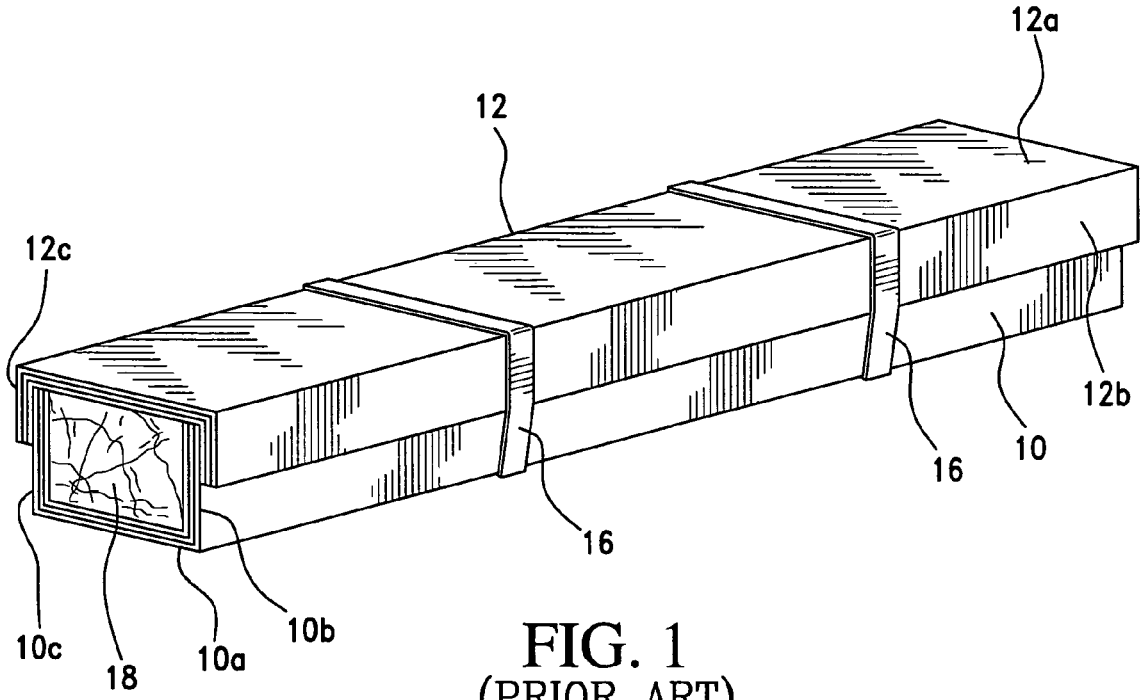
FIG. 1 (PRIOR ART)
FIG. 1 is a perspective view of a first PRIOR ART packaging container.
Figure 1A:
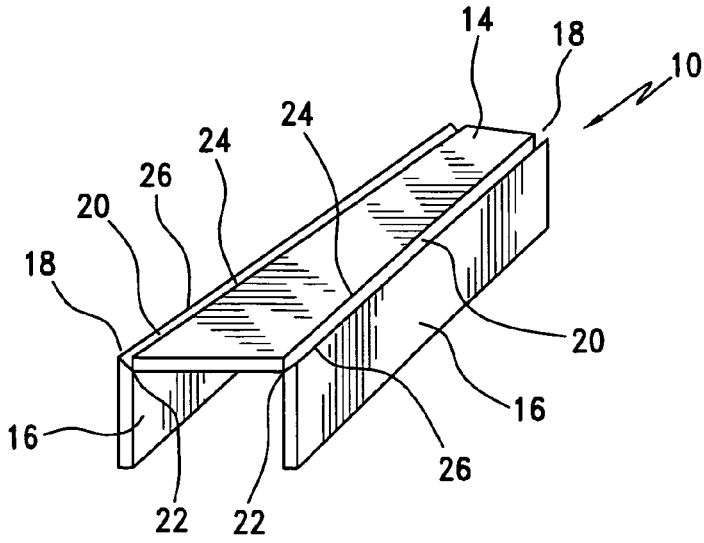
FIG. 1a (PRIOR ART)
FIG. 1*a* is a perspective view of a second PRIOR ART packaging container.

It can therefore be appreciated that if the new and improved living hinge pivotal structure was not integrally incorporated within the interior corner region 118 defined between the right side upstanding wall portion or leg member 116 and the base or bottom member 112, wherein, for example, both of the left and right side upstanding wall portions or leg members 114, 116 were permanently disposed in their upright positions perpendicular to the base or bottom member 112, as is typical of the PRIOR ART packaging container structure 10 disclosed within FIG. 1, then it might be somewhat difficult to properly maneuver and deposit each one of the substantially flat or planar articles 124 into the interior container region 122 of the packaging structure 110. To the contrary, however, since the plurality of articles 124 are being deposited into the interior container region 122 of the packaging structure 110 of the present invention in accordance with the aforenoted sideways directional movement SW, there is no need for operator personnel to meticulously navigate the insertion of the plurality of articles 124 between the two left and right upstanding side wall portions or leg members 114, 116.

Still yet further, it can also be appreciated from FIG. 4, that, in a manner similar to that of the PRIOR ART packaging container structure 10, 12 as disclosed within FIG. 1, an upper packaging structure is adapted to be mated with the lower packaging structure so as to form a composite packaging assembly which is generally indicated by the reference character 210 and within which the substantially flat or planar articles 124 are to be disposed and contained. In order to simplify the overall manufacturing process of the composite packaging assembly 210, as well as the mating together of the upper and lower packaging structures, and still further, in order to render the manufacture of the composite packaging assembly 210 cost effective, it is seen that both the upper and lower packaging structures comprising the composite packaging assembly 210 of the present invention comprise identical structures. Accordingly, the lower packaging structure 110 is adapted to have an upper packaging structure 110-U mated therewith wherein the upper packaging structure 110-U is seen to comprise an upper base or top member 112-U, and a pair of oppositely disposed dependent side wall portions or leg members 114-U, 116-U. Continuing still further, in view of the fact that both the lower and upper packaging structures 110, 110-U are identical to each other, then contrary to the PRIOR ART packaging container assembly, as disclosed within FIG. 1, wherein the dependent side wall portions 12*b*, 12*c* of the upper packaging container structure will be disposed externally of the upstanding side wall portions 10*b*, 10*c* of the lower packaging container structure when the upper and lower packaging container structures are mated together, when the upper packaging structure 110-U of the present invention is mated with the lower packaging structure 110 of the present invention, it is seen that the dependent, left side wall portion or leg member 116-U of the upper packaging structure 110-U will be disposed externally of the upstanding left side wall portion or leg member 114 of the lower packaging structure 110, while the dependent right side wall portion or leg member 114-U of the upper packaging structure 110-U will be disposed internally within the upstanding right side wall portion or leg member 116 of the lower packaging structure 110.

It can therefore be appreciated still further from FIGS. 3 and 4 that an additionally important feature characteristic of the present invention packaging structure 110 is that when the plurality of substantially flat or planar articles 124 are inserted into the container region 122 defined within the packaging structure 110 as a result of being moved internally within packaging structure 110 in the sideways direction SW, each one of the articles 124 will have its left side edge portion abutted up against the interior wall surface 126 of the upstanding wall portion or leg member 114 as disclosed, for example, within FIG. 3. In this manner, the right side edge portions of the plurality of substantially flat or planar articles 124 will be uniformly aligned with respect to each other, and will be disposed leftward of the scored region 120 of the packaging structure 110 as defined between the base or bottom member 112 and the right side wall portion or leg member 116, as illustrated within FIGS. 3 and 4, and accordingly, when the right side wall portion or leg member 116 of the packaging structure 110 is returned back from its coplanar position with respect to the base or bottom member 112 of the packaging structure 110, to the upstanding perpendicular position with respect to the base or bottom member 112 of the packaging structure 110, as illustrated by means of the arrow CCW within FIG. 4, it is seen that the right side edge portions of all of the plurality of articles 124 will be spaced a predetermined distance from the interior wall surface 128 of the right side wall portion or leg member 116 of the packaging structure 110 so as to define a space 130 therebetween.

Accordingly, it will be appreciated that when the upper packaging structure 110-U is mated with respect to the lower packaging structure 110 by effectively moving the upper packaging structure 110-U downwardly toward the lower packaging structure 110 as denoted by means of the arrow D, the dependent side wall portion or leg member 114-U of the upper packaging structure 110-U will be able to be accommodated within the space 130. Subsequently, strapping bands, not shown but similar to those disclosed at 16 within FIG. 1, may be secured around the packaging assembly 210. It is lastly noted that while the left upstanding side wall portion or leg member 114 of the packaging structure 110, for example, has been shown or illustrated as being integrally fixed to the base or bottom member 112 of the packaging structure 110, the left upstanding side wall portion or leg member 114 of the packaging structure 110 may be pivotally mounted upon the base or bottom member 112 in a manner similar to that which movably or hingedly connects the right upstanding side wall portion or leg member 116 upon the base or bottom member 112. Under these circumstances, the pivotally mounted, left upstanding side wall portion or leg member 114 of the packaging structure 110 will need to be supported and maintained at its upright, perpendicular position with respect to the base or bottom member 112 so as to effectively define the immovable upstanding wall against which the left side edge portions of the plurality of substantially flat or planar articles 124 can be abutted so as to in fact achieve the desired uniform alignment of the right side edge portions of the substantially flat or planar articles 124 within the packaging structure 110.

Figure 5:
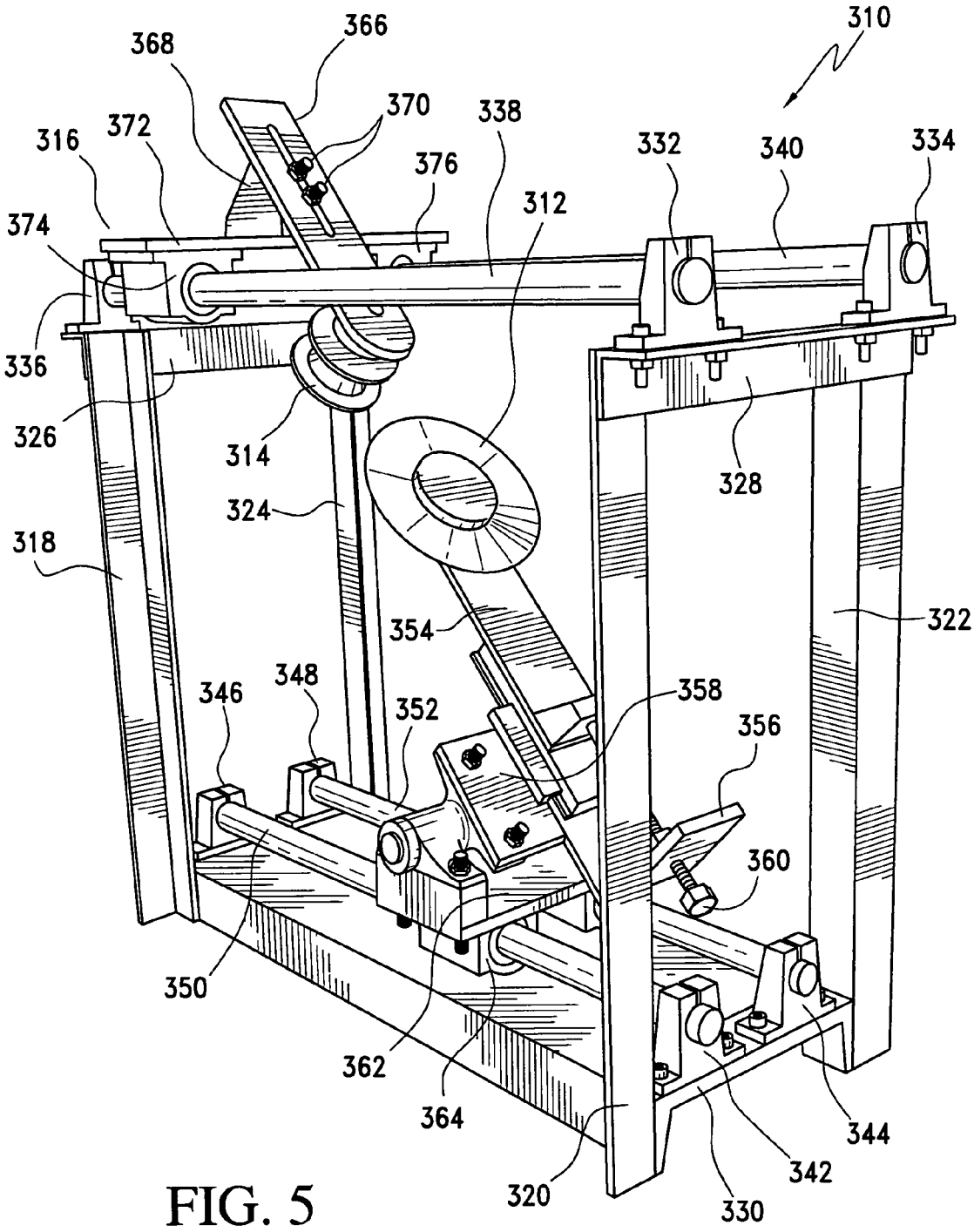
FIG. 5 is a perspective view of apparatus, comprising a free-wheeling rotary, cutting blade, and a cooperating back-up roller, for scoring the interior corner joint region defined between the base member of the packaging structure and one of the upstanding side wall portions or leg members so as to permit the upstanding side wall portion or leg member to be pivotally movable between the aforenoted 90° and 180° positions with respect to the base member of the packaging structure.
Figure 6:
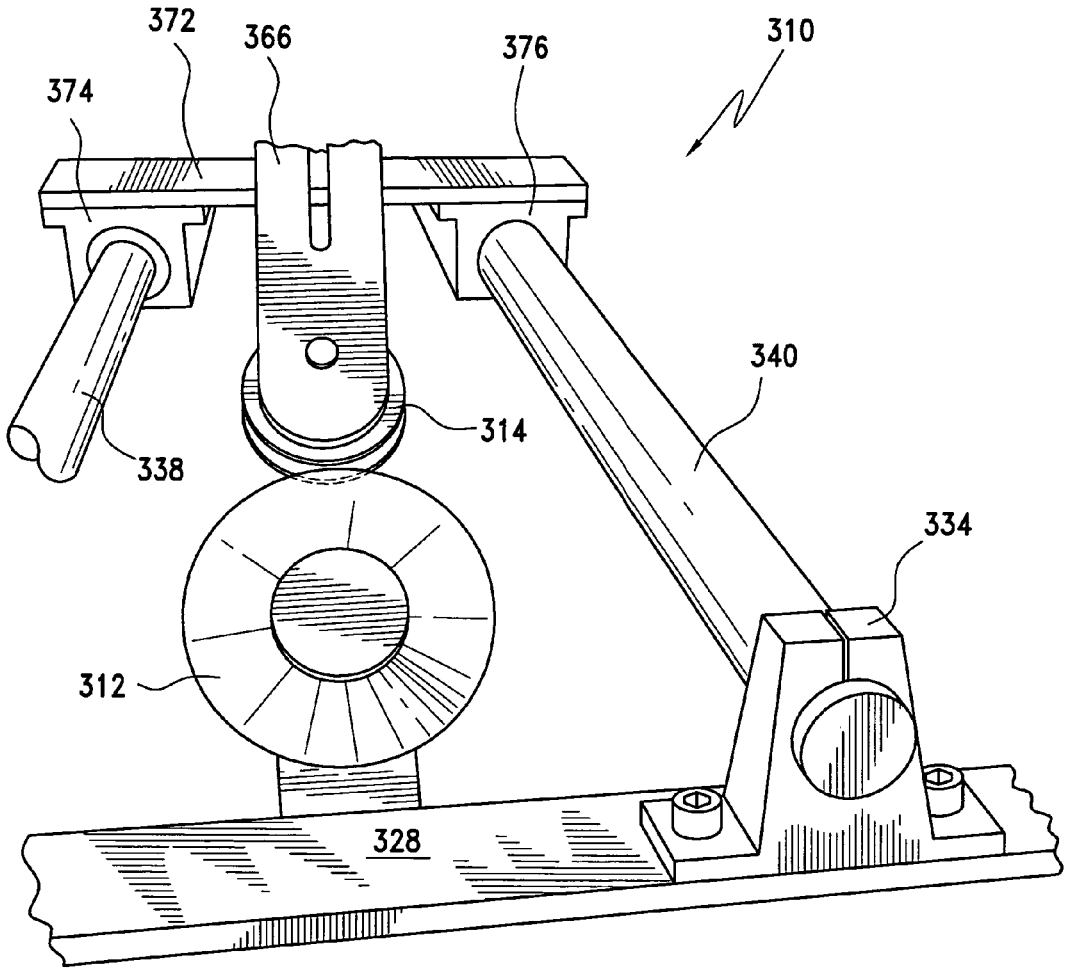
FIG. 6 is an enlarged front elevational view of the cutting blade as illustrated within FIG. 5 showing its operative cooperation with the back-up roller mechanism so as to effectively score the interior corner joint region defined between one of the upstanding side wall portions or leg members, and the base member, of one of the packaging structures whereby the upstanding side wall portion or leg member of the scored packaging structure can be pivotally moved between the aforenoted 90° and 180° positions with respect to the base member of the packaging structure.

Having described the new and improved packaging structure 110 of the present invention, the apparatus for manufacturing such new and improved packaging structure 110 of the present invention, particularly the apparatus for scoring the interior corner joint region of the packaging structure 110 so as to form the living hinge structure pivotally connecting the right upstanding side wall portion or leg member 116 of the packaging structure 110 to the base or bottom member 112 of the packaging structure 110, will now be described. With reference being made to FIGS. 5 and 6, it is seen that the apparatus for scoring the interior corner joint region of the packaging structure 110 is generally indicated by the reference character 310, and it is additionally seen that the apparatus 310 comprises substantially two primary components, that is, a rotary cutting blade 312 and a rotary back-up roller mechanism 314. As may be appreciated, as each one of the packaging structures 110 is conveyed in a downstream direction, as the same is effectively discharged, for example, from the laminating machine or apparatus, not shown, within which the laminated paperboard packaging structure 110 is fabricated, the laminated paperboard packaging structure 110 will be conveyed in an upside-down mode so as to be positionally oriented in a manner similar to that of the upper packaging structure 110-U as illustrated within FIG. 4. Therefore the scoring process for forming the living hinge structure within the interior corner region 118 of every packaging structure 110 will actually be described in connection with the upper packaging structure 110-U so as to simplify the visualization of the scoring process.

Accordingly, as the packaging structure 110-U is conveyed past the scoring apparatus, comprising the rotary cutting blade 312 and the back-up roller 314, the interior corner region 118-U of the packaging structure 110-U will effectively be interposed between the rotary cutting blade 312 and the rotary back-up roller mechanism 314 whereby, with the external surface portion of the corner region of the packaging structure 110-U effectively engaging and being supported upon the back-up roller 314, the rotary cutting blade 312 will rotatably engage the interior corner region 118-U of the upper packaging structure 110-U so as to properly score the same and effectively form the living hinge structure within the interior corner region 118-U of the upper packaging structure 110-U. It can be appreciated that the rotary cutting blade 312 and the rotary back-up roller mechanism 314 are adapted to be adjustably positioned with respect to each other so as to adjust the effective size of the nip defined between the rotary cutting blade 312 and the rotary back-up roller mechanism 314 whereby the depth of the cut defined within the interior corner region 118-U of the packaging structure 110-U can be adjusted so as to accordingly adjust, for example, the flexibility and resiliency characteristics of the living hinge structure defined within the corner region 118-U of the packaging structure 110-U.

In connection with the adjustable mountings of the rotary cutting blade 312 and the rotary back-up roller mechanism 314, it is seen that both the rotary cutting blade 312 and the rotary back-up roller 314 components are mounted upon a framework 316 which comprises, for example, four upstanding corner posts 318, 320, 322, 324, and four transversely or horizontally oriented support beams comprising a pair of upper support beams 326, 328 and a pair of lower support beams, only the front one of which is visible at 330. Four support blocks are fixedly mounted upon the upper support beams 326, 328, as illustrated at 332, 334, 336, the fourth one of which is not visible, and a pair of laterally spaced upper guide rods 338, 340 have their opposite ends fixedly mounted within the three illustrated fixed support blocks 332, 334, 336 and the fourth fixed support block which is not visible. In a similar manner, a pair of support blocks 342, 344 are fixedly mounted upon the forwardly disposed lower support beam 330, a pair of support blocks 346, 348 are fixedly mounted upon the rearwardly disposed lower support beam, not visible, and a pair of laterally spaced lower guide rods 350, 352 have their opposite ends fixedly mounted within the four illustrated lower fixed support blocks 342, 344, 346, 348. The rotary cutting blade 312 is rotatably mounted upon a support arm 354 in a free-wheeling manner, and the support arm 354 is, in turn, slidably disposed upon a substantially L-shaped mounting bracket 356 which is fixedly mounted upon a mounting block assembly 358 having a substantially triangular cross-sectional configuration. An adjustment screw mechanism 360 is mounted within the mounting bracket 356 and is operatively engaged with the slidable support arm 354. The mounting block assembly 358 is, in turn, fixedly mounted upon a support platform 362, and opposite sides of the support platform 362 are fixedly mounted upon a pair of slide blocks, only one which is visible at 364, which are respectively adjustably mounted upon the laterally spaced lower guide rods 350, 352 by suitable means, not shown.

In connection with the adjustable mounting of the back-up roller mechanism 314, it is seen that the back-up roller mechanism 314 is likewise rotatably mounted in a free-wheeling manner upon a support arm 366, and that the support arm 366 is slidably mounted upon a mounting bracket 368, having a substantially triangular cross-sectional configuration, by means of set screws 370. The mounting bracket 368 is, in turn, mounted upon a support platform 372, and opposite sides of the support platform 372 are fixedly mounted upon a pair of slide blocks 374, 376 which are respectively adjustably mounted upon the laterally spaced upper guide rods 338, 340 by suitable means, not shown. Therefore, as a result of the various positional adjustments, such as, for example, the adjustable movement of the rotary cutter blade slide blocks 364 along the lower guide rods 350, 352, as well as the adjustable movement of the back-up roller slide blocks 374, 376 along the upper guide rods 338, 340, the rotary cutter blade 312 and the back-up roller 314 can be aligned in a coplanar manner with respect to each other along the inclined plane as illustrated within FIG. 5. In addition, the rotary cutter blade support arm 354 can be slidably adjusted along the mounting bracket 356, while the back-up roller support arm 366 can be slidably adjusted along the mounting bracket 368. Accordingly, the coplanar distance defined between the rotary cutting blade 312 and the back-up roller 314 can be adjusted such that the nip defined between the rotary cutter blade 312 and the back-up roller 314 will have a predetermined value.

Thus, it may be seen that in accordance with the teachings and principles of the present invention, there has been developed a new and improved packaging structure which comprises the substantially U-shaped structure formed by means of the base member and the pair of oppositely disposed upstanding side wall portions or leg members, and wherein at least one of the interior corner regions, defined at the intersection or joint between one of the oppositely disposed upstanding side wall portions or leg members and the base member, has been scored so as to permit that particular upstanding side wall portion or leg member to be pivotally movable between its first position at which the side wall portion or leg member is disposed perpendicular, or at an angle of 90°, with respect to the base member, and its second position at which the pivotally movable side wall portion or leg member is disposed in a coplanar manner, or at an angle of 180°, with respect to the base member. In this manner, when the substantially flat or planar articles are to be inserted into and disposed within the packaging structure, the pivotally movable upstanding side wall portion or leg member can be moved from its 90° or upright position, to its 180° or lowered coplanar position, with respect to the base member so as to enable the articles to be moved laterally across the upper surface of the base member until the internal edge portion of each article abuts the oppositely disposed upstanding side wall portion or leg member of the packaging structure. Accordingly, uniform alignment of all of the articles within the packaging structure is ensured. When all of the articles are disposed within the packaging structure, the pivotally movable side wall portion or leg member is then of course moved from the aforenoted 180° or lowered coplanar position, back to the aforenoted 90° or upright position, with respect to the base member so as to effectively entrap the articles between the pair of oppositely disposed upstanding side wall portions or leg members. The second packaging structure is then mated with the first packaging structure so as to fully encase or envelop the articles therewithin and thereby complete the packaging assembly, and suitable strapping bands are secured around the completed packaging assembly. The apparatus for achieving the aforenoted scoring of the interior corner joint region of the packaging structure comprises the free-wheeling rotary cutting blade mechanism which is adapted to cooperate with the free-wheeling support roller for effectively supporting the elongated laminated paperboard product being conveyed along the longitudinal extent thereof and prior to the cutting of the same into its predetermined length units for its predetermined end uses.

Obviously, many variations and modifications of the present invention are possible in light of the above teachings. It is therefore to be understood that within the scope of the appended claims, the present invention may be practiced otherwise than as specifically described herein.

The invention claimed is:

1. A packaging structure for containing articles, comprising:

a base member; and a pair of side wall members connected to opposite sides of said base member so as to form with said base member a three-sided packaging structure which has a substantially U-shaped cross-sectional configuration that is open along its top and at both opposite ends thereof, and which defines therewithin an interior space for accommodating articles to be contained within said three-sided packaging structure;

wherein a first one of said pair of side wall members is integrally and fixedly connected to a first one of said opposite sides of said base member so as to form with said base member a single structural entity having a substantially L-shaped cross-sectional configuration wherein said first one of said pair of side wall members is permanently disposed in a substantially perpendicular orientation with respect to said base member, and wherein a second one of said pair of side wall members is pivotally connected to a second one of said opposite sides of said base member by means of a living hinge structure, defined upon an interior corner region of said packaging structure, between said second one of said pair of side wall members and said base member of said packaging structure, for permitting said second one of said pair of side wall members to be moved from a first position, at which said second one of said pair of side wall members is disposed substantially perpendicular to said base member, to a second position at which said second one of said pair of side wall members is disposed in a substantially coplanar manner with respect to said base member so as to effectively open one side of said three-sided packaging structure and thereby permit articles, to be disposed within said interior article containment space, to be inserted into said interior article containment space in a sideways direction.

2. The packaging structure as set forth in claim 1, wherein:

said means for defining said living hinge structure upon said interior corner region of said packaging structure comprises scoring of said interior corner region of said packaging structure to a predetermined depth dimension.

3. The packaging structure as set forth in claim 1, wherein:

said three-sided packaging structure has said substantially U-shaped cross-sectional configuration comprising said base member and a pair of upstanding side wall members.

4. The packaging structure as set forth in claim 1, wherein:

said first one of said pair of side wall members comprises an interior wall surface portion against which first side edge portions of the articles, to be inserted into said interior article containment space, can be abutted so as to properly align the articles disposed within said interior article containment space.

5. The packaging structure as set forth in claim 4, wherein:

said first one of said pair of side wall members of said first packaging structure, comprising said interior wall surface portion against which first side edge portions of the articles, to be inserted into said interior article containment space, can be abutted so as to properly align the articles disposed within said interior article containment space, is spaced a predetermined distance from an interior wall surface of said second one of said pair of side wall members such that when the articles, to be inserted into and disposed within said interior article containment space, abut said interior wall surface portion of said first one of said pair of side wall members, second opposite side edge portions of the articles, to be inserted into and disposed within said interior article containment space, will be spaced a predetermined distance from said interior wall surface portion of said second one of said pair of side wall members so as to define a space, between the second opposite side edge portions of the articles, disposed within said interior article containment space, and said interior wall surface portion of said second one of said pair of side wall members so as to accommodate a side wall member of a second mating packaging structure.

6. The packaging structure as set forth in claim 1, wherein:

said packaging structure is fabricated from laminated paperboard.

7. A packaging assembly for containing articles, comprising:

a first packaging structure comprising a base member; and a pair of side wall members connected to opposite sides of said base member so as to form with said base member a three-sided packaging structure which has a substantially U-shaped cross-sectional configuration that is open along its top and at both opposite ends thereof, and which defines therewithin an interior space for accommodating articles to be contained within said three-sided packaging structure; wherein a first one of said pair of side wall members is integrally and fixedly connected to a first one of said opposite sides of said base member so as to form with said base member a single structural entity having a substantially L-shaped cross-sectional configuration wherein said first one of said pair of side wall members is permanently disposed in a substantially perpendicular orientation with respect to said base member, and wherein a second one of said pair of side wall members is pivotally connected to a second one of said opposite sides of said base member by means of a living hinge structure, defined upon an interior corner region of said packaging structure, between said second one of said pair of side wall members and said base member of said packaging structure, for permitting said second one of said pair of side wall members to be moved from a first position, at which said second one of said pair of side wall members is disposed substantially perpendicular to said base member, to a second position at which said second one of said pair of side wall members is disposed in a substantially coplanar manner with respect to said base member so as to effectively open one side of said three-sided packaging structure and thereby permit articles, to be disposed within said interior article containment space, to be inserted into said interior article containment space in a sideways direction; and a second packaging structure which is adapted to be mated with said first packaging structure so as to form said packaging assembly.

8. The packaging assembly as set forth in claim 7, wherein:

both of said first and second packaging structures are identical with respect to each other.

9. The packaging assembly as set forth in claim 8, wherein:

said first packaging structure comprises said three-sided packaging structure having said substantially U-shaped cross-sectional configuration comprising said base member and a pair of upstanding side wall members; and said second packaging structure comprises a three-sided packaging structure having a substantially U-shaped cross-sectional configuration comprising said base member and a pair of dependent side wall members.

10. The packaging assembly as set forth in claim 8, wherein:

said first one of said pair of side wall members of said first packaging structure comprises an interior wall surface portion against which first side edge portions of the articles, to be inserted into said interior article containment space, can be abutted so as to properly align the articles disposed within said interior article containment space.

11. The packaging assembly as set forth in claim 10, wherein:

said first one of said pair of side wall members of said first packaging structure, comprising said interior wall surface portion against which first side edge portions of the articles, to be inserted into said interior article containment space, can be abutted so as to properly align the articles disposed within said interior article containment space, is spaced a predetermined distance from an interior wall surface of said second one of said pair of side wall members of said first packaging structure such that when the articles, to be inserted into and disposed within said interior article containment space, abut said interior wall surface portion of said first one of said pair of side wall members of said first packaging structure, second opposite side edge portions of the articles, to be inserted into and disposed within said interior article containment space, will be spaced a predetermined distance from said interior wall surface portion of said second one of said pair of side wall members of said first packaging structure so as to define a space, between the second opposite side edge portions of the articles, disposed within said interior article containment space, and said interior wall surface portion of said second one of said pair of side wall members of said first packaging structure so as to accommodate a side wall member of said second packaging structure.

12. The packaging assembly as set forth in claim 8, wherein:

both of said first and second packaging structures are fabricated from laminated paperboard.

13. The packaging assembly as set forth in claim 7, wherein:

said means for defining said living hinge structure upon said interior corner region of said first packaging structure comprises scoring of said interior corner region of said first packaging structure to a predetermined depth dimension.

* * * * *